United States Patent [19]

Tamatani

[11] Patent Number: 4,730,643

[45] Date of Patent: Mar. 15, 1988

[54] MISPICK REMOVING DEVICE FOR A SHUTTLELESS LOOM

[75] Inventor: Yasuyuki Tamatani, Ishikawa, Japan

[73] Assignee: Tsudakoma Corp., Kanazawa, Japan

[21] Appl. No.: 939,381

[22] Filed: Dec. 8, 1986

[30] Foreign Application Priority Data

Mar. 11, 1986 [JP] Japan ..... 61-051479

[51] Int. Cl.[4] ..... D03D 47/30

[52] U.S. Cl. ..... 139/116

[58] Field of Search ..... 139/11 R, 116, 429, 139/435

[56] References Cited

U.S. PATENT DOCUMENTS

| | | | |
|---|---|---|---|
| 4,270,579 | 6/1981 | Nakanishi . | |
| 4,502,512 | 3/1985 | Suzuki et al. | 139/116 |
| 4,503,889 | 5/1983 | van Mullekom . | |
| 4,620,570 | 5/1983 | Suzuki . | |
| 4,664,157 | 1/1986 | Shin . | |
| 4,688,606 | 8/1987 | Tamatani . | |

FOREIGN PATENT DOCUMENTS

| | | | |
|---|---|---|---|
| 150763 | 8/1985 | European Pat. Off. | 139/435 |

*Primary Examiner*—Henry S. Jaudon

*Attorney, Agent, or Firm*—Flynn, Thiel, Boutell & Tanis

[57] ABSTRACT

A mispick removing device capable of extracting the broken pieces of a mispick through the opposite selvages of the fabric, respectively, in case of the breakage of a picked weft yarn within the shed, and capable of extracting a mispick through the selvage of the fabric on the picking side of the loom in case of faulty picking operation other than the breakage of the picked weft yarn. The mispick removing device comprises a picking-side mispick removing mechanism disposed on the picking side of the loom, and a receiving-side mispick removing mechanism disposed opposite to the picking-side mispick removing mechanism with respect to the fabric. The mispick removing device is controlled automatically for mispick removing operation.

7 Claims, 11 Drawing Figures

MISPICK REMOVING DEVICE FOR A SHUTTLELESS LOOM

BACKGROUND OF THE INVENTION

1. Field of the Invention

The present invention relates to an automatic weave mending device for extracting a mispick inserted by a faulty picking operation and automatically restarting the loom after the extraction of the mispick and, more particularly, to a mispick removing device capable of extracting a mispick from the fabric through either one or the other selvage of the fabric.

2. Prior Art

U.S. Pat. No. 4,502,512 discloses an invention which separates a mispick from the cloth fell, and then extracts the mispick from the fabric by the winding action of a waste roller or by the suction of a suction nozzle. This invention however, needs a mispick separating means of a special construction.

The applicant of the present application has proposed a mispick removing device capable of extracting a mispick from the cloth fell without using a special mispick separating means such as employed in the above-mentioned prior art in Japanese Patent Application No. 60-089,720 (U.S. Pat. No. 4,688,606 European Patent Application No. 105,687.7). This mispick removing device actuates, when a weft stop signal is provided, the guide nozzle thereof disposed adjacent to the picking nozzle of the loom to move a weft yarn having a faultily picked portion away from the picking path to a winding device avoiding the cutter on the picking side, then cuts the weft yarn at a position near the free end of the picking nozzle, and then extracts the mispick from the cloth fell by drawing the mispick diagonally relative to the cloth fell by the winding device.

However, if the picked weft yarn is broken at a position intermediate portion by the jet of the picking fluid or by some cause, the broken end of the picked weft yarn will be left in the cloth fell when the picked weft yarn is extracted toward the picking side, and hence the complete removal of the mispick is impossible.

SUMMARY OF THE INVENTION

Accordingly, it is an object of the present invention to provide a mispick removing device capable of completely removing a mispick even when a weft yarn is broken at a position in the intermediate portion thereof.

According to the present invention, a mispick removing device comprises two mispick removing mechanisms disposed on the picking side and the receiving side, respectively of the loom, and is capable of extracting the broken pieces of a mispick through the opposite selvages of the fabric when the picked weft yarn is broken at a position in the intermediate portion thereof so that the broken pieces of the mispick can completely be removed from the fabric.

The mispick removing device according to the present invention detects the existence of a mispick during a mispick winding-off operation or after the completion of the mispick winding-off operation by a detector and an appropriate mispick removing operation is performed accordingly. Therefore, the mispick removing device prevents the erroneous restart of the loom before the complete removal of the mispick without fail. Accordingly, the mispick removing device according to the present invention enables a reliable automatic weave mending operation.

DESCRIPTION OF THE PREFERRED EMBODIMENT

Figure 1:
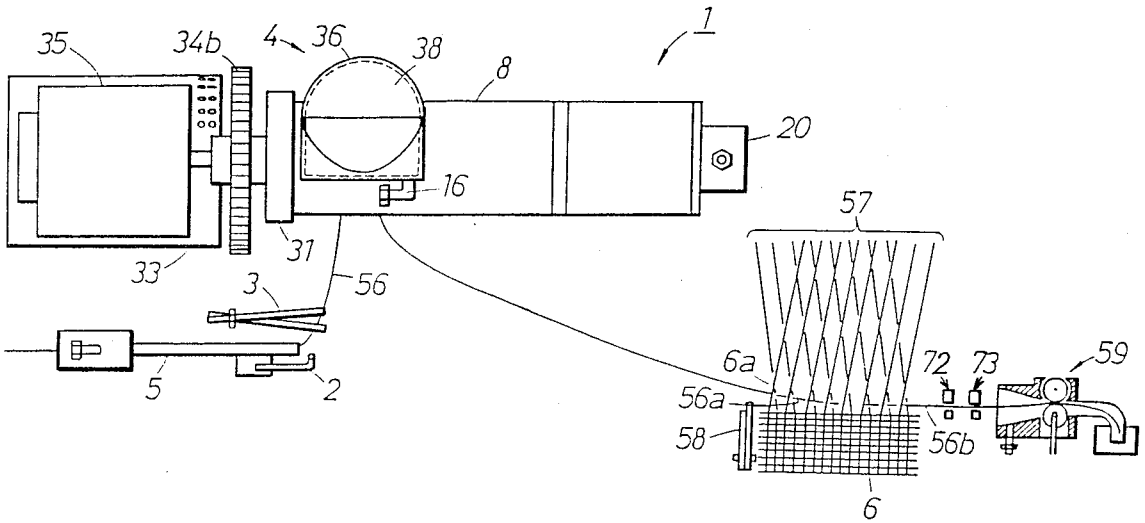
FIG. 1 is a plan view of a mispick removing device, in a preferred embodiment, according to the present invention.
Figure 2:
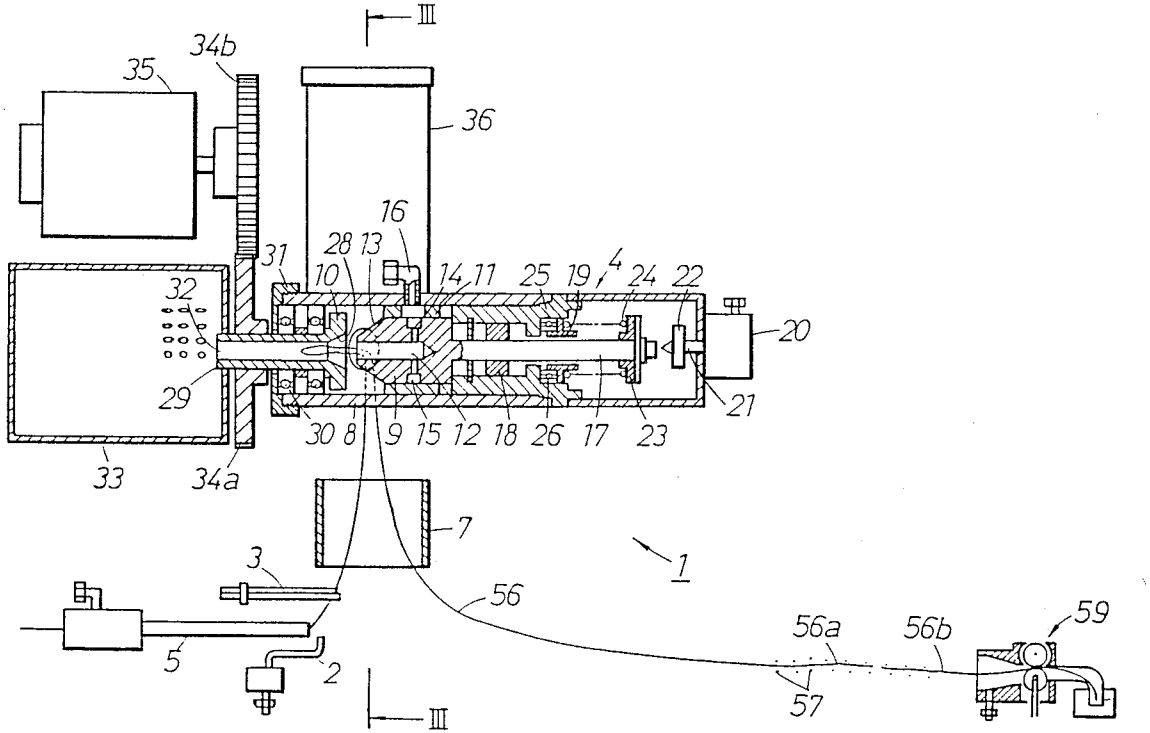
FIG. 2 is a longitudinal sectional view of the mispick removing device of FIG. 1.
Figure 3:
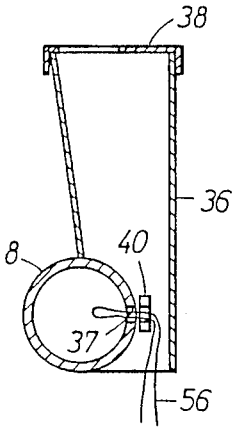
FIG. 3 is a sectional view taken on line III—III in FIG. 2.

FIGS. 1 to 3 illustrate the mechanical constitution of a mispick removing device 1 according to the present invention. The mispick removing device 1 comprises, as the principal components, a guide nozzle 2, a cutter 3, a picking-side mispick removing mechanism 4, and a receiving-side mispick removing mechanism 59.

The guide nozzle 2 is disposed between a picking nozzle 5 and the selvage of the fabric 6 on the picking side, and is directed in a direction deviating from the direction of the picking path, for example, diagonally upward. The cutter 3 is disposed between the free end of the picking nozzle 5 and a tubular yarn guide 7 adjacent to the free end of the picking nozzle 5. The cutter 3 and the yarn guide 7 are fixed to suitable holding means at fixed positions, respectively.

The picking-side mispick removing mechanism 4 has a tubular housing 8, and winding means comprising a winding member 9 and a rotary member 10 which are journaled within the housing 8. The winding member 9 has a shaft 17 supported rotatably and axially slidably on a linear bearing 18. A nozzle hole 12 is formed in the central portion of the free end of the winding member 9. The circumference of the free end of the winding member 9 is tapered to form a winding surface 13. The nozzle hole 12 communicates with a connector 16 attached to housing 8 for receiving a fluid, by means of holes 14 and a circumferential annular groove 15 formed in the winding member 9, and a hole formed in a slide bearing 11. The shaft 17 is formed integrally with the winding mewmber 9 so as to extend rearward from the center of the rear end of the wind member 9. The shaft is supported rotatably and axially slidably on the linear bearing 18 with the free end thereof opposite a pushing member 22 fixed to the piston rod 21 of a power cylinder 20. A coil spring 24 is provided between a sleeve 19 serving as a spring seat, and a spring seat 23 provided at the right end, as viewed in FIG. 2, of the shaft 17 to bias always the shaft 17 rightward. The rightward movement of the winding member 9 is limited by a cap 25, while the leftward movement of the same is limited by the rotary member 10. The sleeve 19 is supported rotatably on a ball bearing 26 within the cap 25 attached to the right end of the housing 8.

A conical recess 28 fitting the conical winding surface 13 of the winding member 9 is formed in the end surface of the rotary member 10. A hollow rotary shaft 29 formed integrally with the rotary member 10 extends leftward, as viewed in FIG. 2, and is supported rotatably on a ball bearing 30 within the housing 8. The ball bearing 30 is held in place with a cover 31 attached to the opening of the housing 8. The hollow interior of the rotary shaft 29 serves as a discharge passage 32. The free end, namely, the left end, of the rotary shaft 29 is thrusted into a trash box 33. A driving motor 35 drives the rotary member 10 at a predetermined rotating speed through a gear **34*b* attached to the output shaft of the driving gear 35, and a gear 34*a* engaging the gear 34*b* and fixed to the rotary member 10**.

Figure 4:
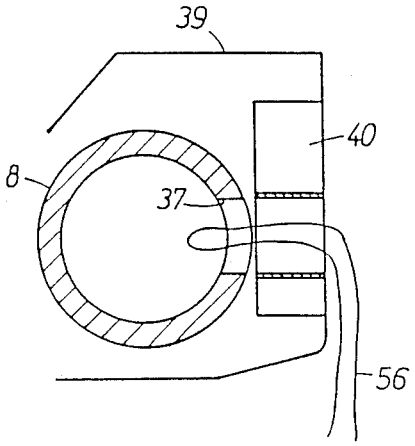
FIG. 4 is an enlarged sectional view of a portion of the mispick removing device of FIG. 1, showing the arrangement of a yarn detector.
Figure 5:
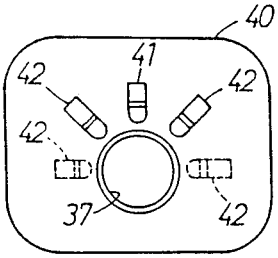
FIG. 5 is an enlarged front view of the yarn detector.

Thus, the winding member 9 and the rotary member 10 are disposed within the housing 8 opposite to each other with an appropriate interval therebetween. A guide tube 36 is joined to the housing at a position corresponding to the interval between the winding member 9 and the rotary member 10. The guide tube 36 has an open upper end and an open lower end, and communicates with the interior of the housing 8 at a position corresponding to the interval by means of a guide hole 37 formed in the housing 8 as illustrated in FIG. 3. The guide tube 36 is joined to the housing 8 at a part thereof slightly below the middle thereof. When necessary, a baffle plate 38 may be provided to cover part of the upper opening of the guide tube 36. As illustrated in FIGS. 4 and 5, a yarn detector 40 is held adjacent to the guide hole 37 on a holding plate 39. The yarn detector 40 comprises, by way of example, one light projecting device 41 and two light receiving devices 42, which are distributed around the guide hole 37 and are directed toward the center of the guide hole 37. The light receiving devices 42 are disposed symmetrically with respect to the center of the guide hole 37.

Figure 6:
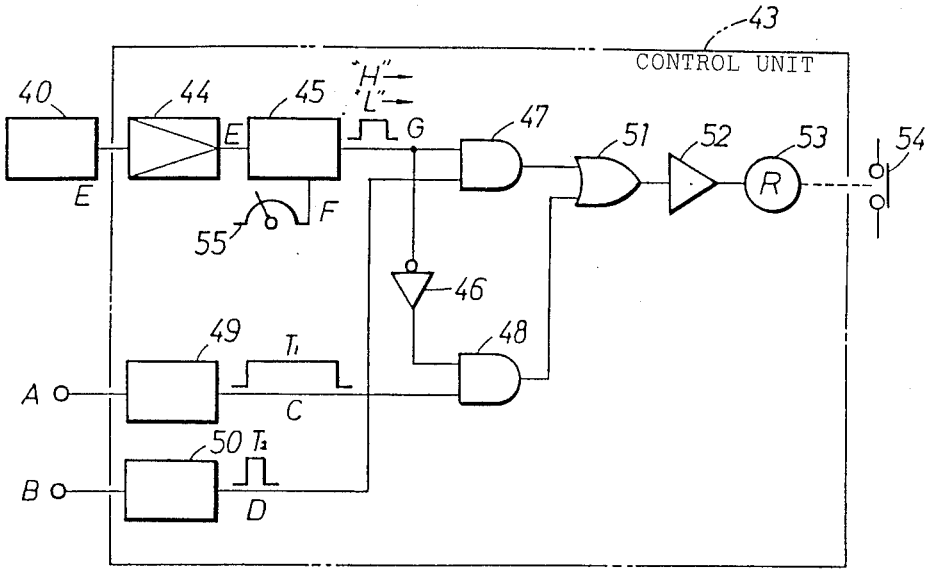
FIG. 6 is a block diagram showing the constitution of a control unit incorporated into the mispick removing device of FIG. 1.

FIG. 6 illustrates the constitution of a control unit 43. The yarn detector 40 is connected through an amplifier 44 to one of the inputs of a comparator 45. A reference value setting device 55 is connected to the other input of the comparator 45. The output of the comparator 45 is connected directly to one of the inputs of an AND gate 47, and through a NOT gate 46 to one of the inputs of an AND gate 48. The respective outputs of a first timer 49 and a second timer 50 are connected to the other input of the AND gate 47 and to the other input of the AND gate 48, respectively. The first timer 49 and the second timer 50 produce timing signals C and D of fixed time duration T1 and T2 after receiving a winding start signal A and a winding end signal B, respectively. The respective outputs of the AND gates 47 and 48 are connected to the inputs of an OR gate 51, respectively. The output of the OR gate 51 is connected through a driver 52 to a relay 53. The relay 53 has a relay contact 54 and a circuit which produces a signal to control the relay contact 54 for inhibiting the restart of the loom or interrupting a mispick removing operation.

Figure 7B:
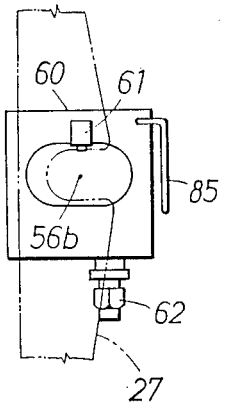
FIG. 7B is a side elevation of the mispick removing mechanism of FIG. 7A.
Figure 7A:
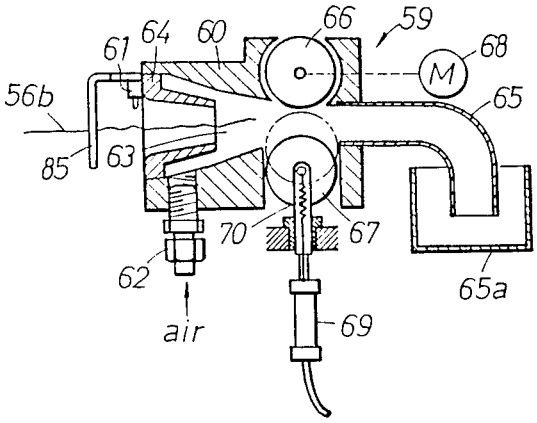
FIG. 7A is a sectional view of a receiving-side mispick removing mechanism.
Figure 8:
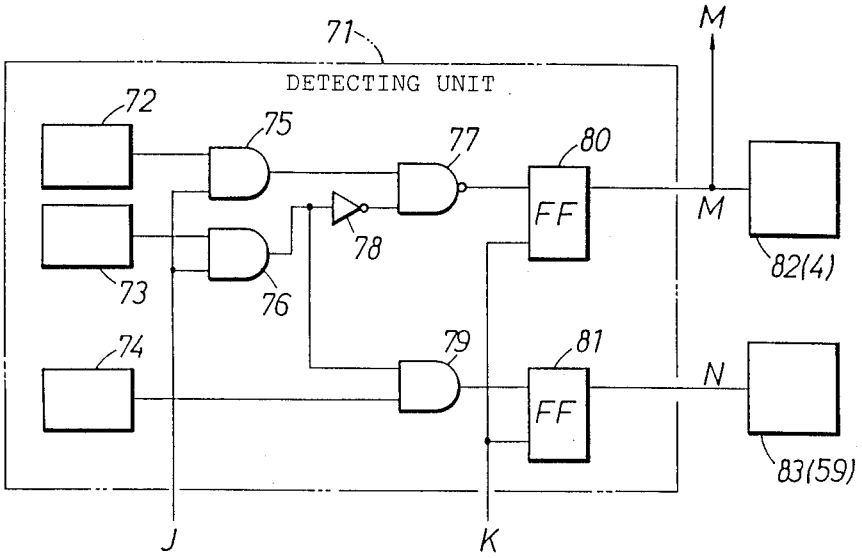
FIG. 8 is a block diagram of a detecting unit.

FIGS. 7 and 8 illustrates the receiving-side mispick removing mechanism 59. The mispick removing mechanism 59 is disposed substantially opposite to the picking nozzle 5 with the fabric 6 therebetween. The receiving side mispick removing mechanism 59 is disposed opposite to the reed 27 of the loom. The mispick removing mechanism 59 has a main body 60. A yarn detector 61 for detecting a weft yarn, a suction nozzle 64 which produces a negative pressure in the vicinity of the opening 63 thereof by the agency of compressed air supplied thereto through an air supply port 62, and a yarn guide 85 are attached to the main body 60. A driving roller 66 and a driven roller 67 are disposed in an air passage formed in the main body 60. An exhaust duct 65 is attached to the outlet end of the main body 60. The driving roller 66 is driven by a driving motor 68. The driven roller 67 is moved towards and away from the driving roller by a pneumatic cylinder 69. Normally, the driven roller 67 is separated from the driving roller 66 and is held at a resting position by the agency of a return spring 70. Compressed air is supplied to the pneumatic cylinder 69 to bring the driven roller 67 into contact with the driving roller 66, so that the driven roller 67 is rotated by the driving roller 66. The free end of the exhaust duct 65 is bent downward. A waste box **65*a* for receiving waste yarns 56*b* discharged from the exhaust duct 65 is disposed below the outlet of the exhaust duct 65**.

FIG. 8 illustrates a mipick detecting unit 71 for detecting a faulty picking operation. The mispick detecting unit 71 is provided with two feelers on sensors 72 and 73, and an unwinding detector 74. The two feelers 72 and 73 are, for example, of the photoelectric type, and are distributed along the extension of the picking path of the weft yarn 56. During the normal picking operation, the feeler 72 provides a H-level (high-level) signal upon the detection of the free end of the weft yarn 56, while the feeler 73 provides a H-level signal upon the detection of the free end of the weft yarn 56 in case of a faulty picking operation, such as long pick or the breakage of the picked weft yarn in the shed. In the case of short pick or bent pick, the feelers 72 and 73 are unable to detect the free end of the picked weft yarn 56 and hence provide L-level (low-level) signals, respectively.

Figure 9:
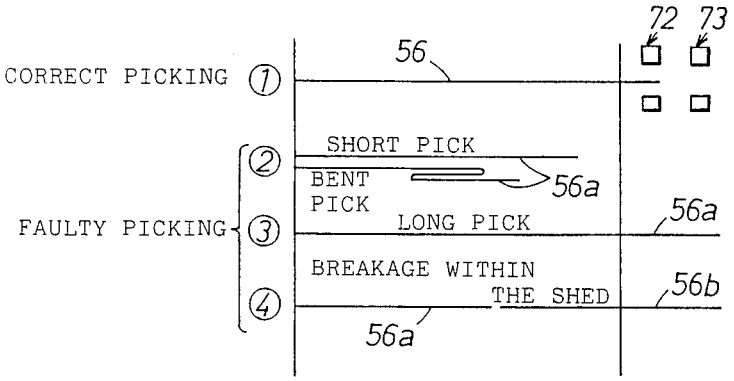
FIG. 9 is a diagrammatic illustration of assistance in explaining modes of picking.

FIG. 9 illustrates exemplary states of picked weft yarns with reference to the feelers 72 and 73. In FIG. 9, a state A is the result of a correct picking operation, while states B, C and D are the results of faulty picking operations, namely, short pick or bent pick, long pick and breakage of the picked weft yarn, respectively.

The unwinding detector 74 is disposed opposite to the circumference of a measuring and storing drum, not shown. The unwinding detector 74 provides a H-level signal when the coils of the weft yarn wound on the measuring and storing drum is unwound by a number corresponding to a length necessary for one picking cycle.

The levels of the output signals of the feelers 72 and 73 and the unwinding detector 74 are tabulated in relation to the states A, B, C and D in the following table.

| | Feeler 72 | Feeler 73 | Detector 74 |
|---|---|---|---|
| State A | H | L | H |
| State B | L | L | H or L |
| State C | H | H | L |
| State D | H | H | H |

The feelers 72 and 73 are connected to one of the inputs of the AND gate 75 and to one of the inputs of the AND gate 76, respectively. A timing signal J is applied to the other inputs of the AND gates 75 and 76. The output of the AND gate 75 is connected directly to one of the inputs of a NAND gate 77, while the output of the AND gate 76 is connected through a NOT circuit 78 to the other input of the NAND gate 77. The output of the AND gate 76 and the output of the unwinding detector 74 are connected to the inputs of an AND gate 79, respectively. The respective outputs of the NAND gate 77 and the AND gate 79 are connected to the respective set inputs of filp-flops 80 and 81, respectively. The flip-flops 80 and 81 are reset by a reset signal K. The respective outputs of the flip-flops 80 and 81 are connected to a controller 82 for controlling the driving motor 35 of the picking-side mispick removing mechanism 4 and a controller 83 for controlling the driving motor 68 of the receiving-side mispick removing mechanism 59, respectively.

The manner of operation of the mispick removing device 1 will be described hereinafter.

In the normal picking cycles, the picking nozzle 5 pulls out the weft yarn 56 stored on the measuring and storing drum, not shown, and picks the weft yarn 56 sequentially into the sheds at a picking crankshaft angle. In the state A, in which a correct picking operation is achieved, both the feeler 72 and the unwinding detector 74 provide H-level signals, respectively, while the feeler 73 provides a L-level signal. Consequently, the NAND gate 77 and the AND gate 79 do not set the corresponding flip-flops 80 and 81.

Upon the occurence of a faulty picking operation, the mispick detecting unit 71 produces, for example, a H-level weft stop signal M. Then, the loom is stopped in the next picking cycle following the faulty picking cycle at a predeterminned crankshaft angle. In the case of the state B, namely, a state in which short pick occured, both the feelers 72 and 73 provide L-level signals, respectively, and hence the AND gates 75 and 76 provide L-level signal upon the reception of the timing signal J. Consequently, the NAND gate 77 provides a H-level signal to set the flip-flop 80 to produce a H-level weft stop signal M. In the case of the state C or D, namely, the state of long pick or weft yarn brakage, the feelers 72 and 73 provide H-level signals, respectively. Accordingly, the flip-flop 80 produces a weft stop signal M and the weft stop signal M is stored. Thus, upon the occurrence of faulty picking operation in the state A, B, C or D, the mispick detecting unit 71 produces a weft stop signal M and gives the weft stop signal M as a command signal for actuating the picking-side mispick removing machanism 4 to the controller 82, and stores the weft stop signal M.

On the other hand, in the states B and C, the number of the unwound coils of the weft yarn does not coincide with a predetermined value; consequently, the unwinding detector 74 provides a L-level signal. However, in the state D in which a predetermined number of coils of the weft yarn are unwound, the unwinding detctor 74 provides a H-level signal; consequently, the flip-flop 81 is switched to the set mode by the output signal of the AND gate 79 to give a command signal N for actuating the receiving-side mispick removing mechanism 59 to the controller 83. Thus, the mispick detecting unit 71 determines the picking conditions from the combination of the output signals of the feelers 72 and 73 and the unwinding detector 74, and then always actuates the picking-side mispick removing mechanism 4 in case of a faulty picking operation and actuates the receiving-side mispick removing mechanism 59 only in case of the state D. The flip-flops 80 and 81 are reset by a reset signal K upon the completion of the mispick removing operation of the picking-side mispick removing mechanism 4 and the receiving-side mispick removing mechanism 59. The feelers and the unwinding detector may be substituted by other known sensors or detectors.

Figure 10:
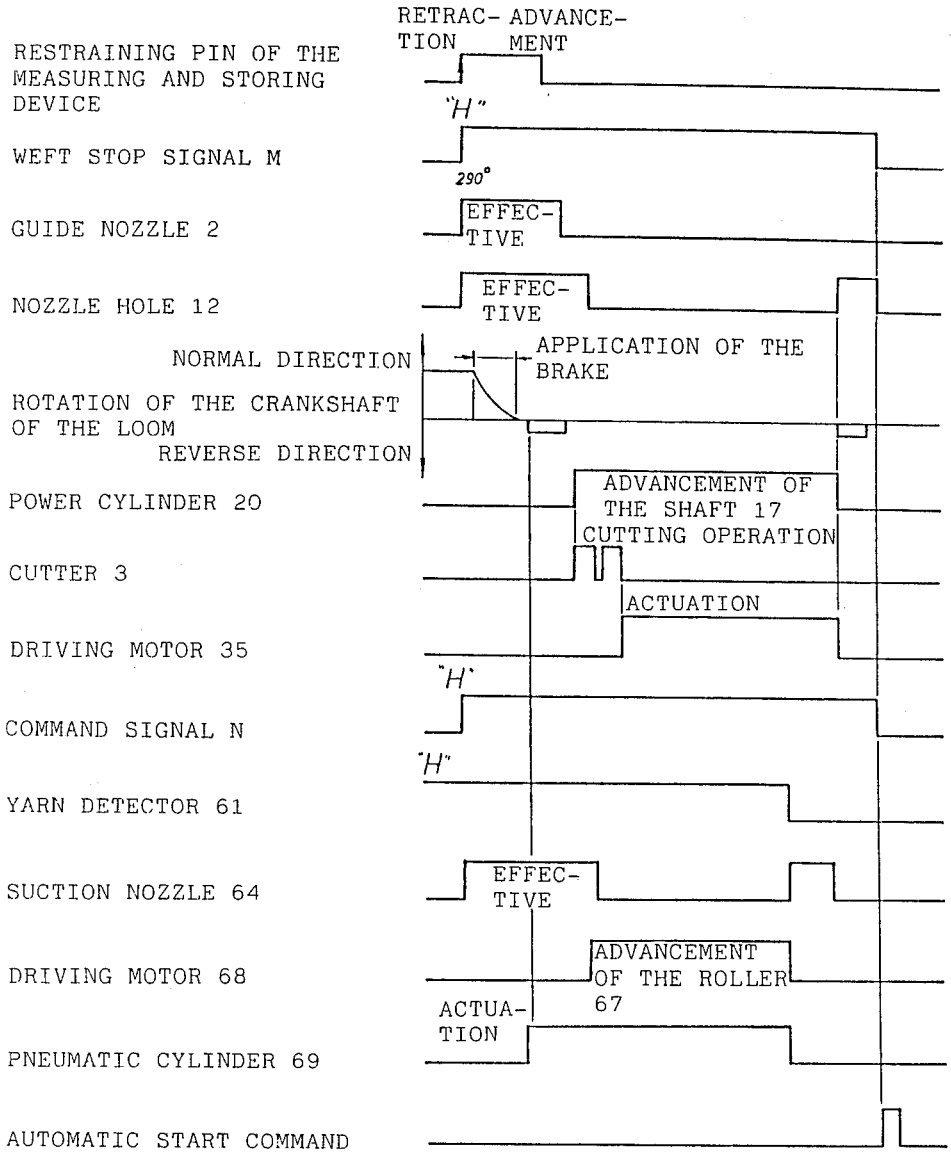
FIG. 10 is a time chart of a series of operations of the mispick removing device of FIG. 1.

A series of mispick removing operations of the picking-side mispick removing mechanism 4 and the receiving-side mispick removing mechanism 59 will be described hereinafter with reference to FIG. 10.

First, the manner of operation of the picking-side mispick removing mechanism 4 will be described. The mispick removing mechanism 4 is actuated in case of every faulty picking operation. Upon the occurence of a faulty picking operation, the weft stop signal M is produced and the restraining pin of the measuring and storing device, not shown, releases the stored weft yarn 56 so that an appropriate length of the weft yarn 56 can be supplied to the picking nozzle 5. The appropriate length of the weft yarn 56 corresponds to a length of the weft yarn 56 at least capable of being extended between the picking nozzle 4 and the guide hole 37 of the picking-side mispick removing mechanism 4. When the measuring and storing device is of the drum type, the appropriate length of the weft yarn 56 can be released by unwinding one of the coils of the weft yarn from the drum. When the measuring and storing device is of the roller-pneumatic storage type, the appropriate length of the weft yarn 56 can be released by opening the clamp disposed before the picking nozzle 5 for a predetermined time.

Upon the reception of the command signal M, namely, the weft stop signal M, the mispick removing mechanism 4 is actuated. Then, the guide nozzle 2 is controlled by the controller 82 for jetting air to make the weft yarn 56 fly between the picking nozzle 5 and the fabric 6 toward the interior of the tubular yarn guide 7 of the nozzle-side mispick removing device 4 so that the weft yarn 56 will not be cut by the cutter 58 disposed beside the selvage of the fabric 6.

At the same time, compressed air is supplied from an external compressed air source to the winding member 10 and is blown through the discharge passage 32 of the winding member 10 to produce a negative pressure in the vicinity of the winding member 10. Consequently, the weft yarn 56 is sucked into the guide tube 36, and then into the discharge passage 32 through the guide hole 37. During the weft yarn sucking operation, the cutter 58 is driven for cutting operation, however, since the weft yarn 56 is sucked apart from the cutter 58, the cutter 58 is unable to cut the weft yarn 56. Accordingly, the weft yarn 56 remains continuous between the picking nozzle 5 and the fabric 6.

After the loom has been braked to a standstill in the next picking cycle, the crankshaft of the loom is rotated in the reverse direction to open the cloth fell **6*a* where the mispick 56*a* extends. At this moment, the guide nozzle 2 stops jetting air, while compressed air is kept being blown through the nozzle hole 12** for some time after the crankshaft of the loom has been rotated in the reverse direction.

While compressed air is blown through the nozzle hole 12, the power cylinder 20 is actuated to move the shaft 17 leftward, as viewed in FIGS. 1 and 2, against the resilience of the coil spring 24 by the pushing member 22 attached to the piston rod 21 of the power cylinder 20. Consequently, the conical winding surface 13 of the winding member 9 engages the conical recess 28 of the rotary member 10 to hold the weft yarn 56 therebetween. At the same time, the cutter 3 is actuated to cut the weft yarn 56 extending between the picking nozzle 5 and the yarn guide 7 at a part near thepicking nozzle 5.

Then, the driving motor 35 is actuated automatically by a command signal to rotate the rotary member 10, and thereby the winding member 9 is driven for rotation at the same rotating speed as that of the rotary member 10 by the rotary member 10 by the agency of the frictional engagement of the conical winding surface 13 and the conical recess 28 thereof to wind the weft yarn 56 around the circumference thereof. Consequently, the mispick 56*a* is extracted from the cloth fell 6*a* of the fabric 6. Since the mispick 56*a* is drawn backward to be away from the cloth fell 6*a*, the mispick 56*a* may be removed from the cloth fell 6*a* with a very slight force compared with the case where the mispick 56*a* is drawn in parallel with the cloth fell 6*a*. Further, the warp yarn may be prevented from being damaged since the tensioned mispick 56*a* does not touch the wrap yarn. The mispick 56*a* can be extracted from the cloth fell 6*a* in such a direction by disposing the yarn guide 7 or the picking-side mispick removing mechanism 4, more specifically, the guide tube 36, when the yarn guide 7 is not provided, behind the extension of the cloth fell 6*a*.

The mispick 56*a* thus extracted is wound in coils around the winding surface 13 of the winding member 9 as the same is rotated by the rotary member 10. After the duration of the mispick winding operation for some time, the driving motor 35 is stopped automatically. Since the piston rod 21 of the power cylinder 20 is retracted prior to stopping the driving motor 35, the winding member 9 is retracted from the operating position by the coil spring 24, so that the winding surface 13 of the winding member 9 is disengaged from the conical recess of the rotary member 10. Upon the separation of the winding surface 13 from the conical recess 28, compressed air is jetted again through the nozzle hole 12 to blow the mispick 56*a* wound around the winding surface 13 toward the conical recess 28 so that the mispick 56*a* is discharged through the interior of the hollow rotary shaft 29 forming the discharge passage 32 into the trash box 33. After the mispick removing operation has thus been completed, the crankshaft of the loom is rotated automatically further in the reverse direction by a predetermined crankshaft angle, and then an operation command signal is provided automatically to restart the loom for the normal weaving operation.

While a series of the mispick removing operations are being performed, the yarn detector 40 detects the mispick 56*a* photoelectrically as the same is sucked through the guide hole 37 and provides a detection signal E continuously. The detection signal E is amplified by the amplifier 44, and then the amplified detection signal E is applied to one of the input of the comparator 45. Then, the comparator 45 compared the detection signal E with a predetermined reference value F and provides a H-level comparison signal G when the mispick is detected, and applies the H-level comparison signal G through the NOT circuit 46 to the AND gate 48. On the other hand, a H-level winding start signal A is applied to the first timer 49 at an appropriate time, then the firsat time 49 applies a H-level timer signal C for a predetermined time T1 to the other input of the AND gate 48. Accordingly, the AND gate 48 provides a H-level signal when the comparator 45 provides a L-level comparison signal G, namely a signal indicating the absence of yarn, while the H-level timer signal C is applied to the AND gate 48. Consequently the driver 52 is actuated through the OR gate 51 to close the relay contact 54 of the relay 53, and thereby a command to inhibit the restart of the loom or a mispick removal interruption command to the control unit of the loom to interrupt the winding operation. Such a procedure is taken in case of the malfunction of the yarn guide or in case of the accidental breakage of the weft yarn.

Upon the reception of a winding end signal B, the second timer 50 is actuated to provide a H-level timer signal D for a predetermined time T2. When the comparator 45 provides a H-level comparison signal G, namely a signal indicating the presence of the weft yarn, while the H-level time signal D is continued, the relay contact 54 of the relay 53 is closed to provide a command signal for inhibiting the restart of the loom or for interrupting the mispick removing operation. This state corresponds to a state in which the mispick is wound faultily or the same is broken. The winding start signal A and the winding end signal B are provided synchronously with the start and the stop, respectively, of the driving motor 35. When necessary, the controller 43 is held inoperative in case of long pick and the breakage of the picked weft yarn.

In the embodiment described herein, the yarn detector 40 is disposed at an optimum position, namely beside the guide hole 37 within the guide tube 36. However, the yarn detector 40 may be disposed at some other position such as a position beside the yarn guide 7. Furthermore, although the yarn detector 40 employed in the embodiment described herein comprises one light projecting device 41 and two light receiving devices 42, the yarn detector 40 may comprise a plurality of light projecting device 41 or more than two light receiving devices 42 in order to enhance the weft yarn detecting capability of the yarn detector 40.

The manner of operation of the receiving-side mispick removing mechanism 59 in case of the breakage of a picked weft yarn will be described hereinafter.

Upon the reception of a command signal N, the controller 83 starts a series of sequential operations. First, compressed air is supplied to the suction nozzle 64 to produce a negative pressure in the vicinity of the opening 63 of the receiving-side mispick removing mechanism 59 to such a broken weft yarn 56*b*. After part of the broken weft yarn 56*b* has been sucked as far as the point of contact of the driving roller 66 and the driven roller 67, compressed air is supplied to the pneumatic cylinder 69 to hold broken weft yarn 56*b* between the diriving roller 66 and the dirven roller 67. Then, the crankshaft of the loom is rotated in the reverse direction so that the broken weft yarn 56*b* is caught by the yarn guide 85 and is separated from the cloth fell. Then, the supply of compressed air to the suction nozzle 64 is interrupted and the driving motor 68 is actuated, and thereby the broken weft yarn 56*b* is extracted as the same is separated from the cloth fell 6*a*.

Upon the passage of the trailing end of the broken weft yarn 56*b* by the yarn detector 61, the level of the output signal of the yarn detector 61 changes from H-level to L-level. In response to the alteration of the level of the output signal of the yarn detector 61, the driving motor 68 is stopped and the supply of compressed air to the pneumatic cylinder 69 is interrupted. At the same time, air is supplied again to the suction nozzle 64 to discharge the broken weft yarn 56*b* through the exhaust duct 65 into the waste box 65*a* together with an air current. Since the driven roller 67 has already been moved away from the driving roller 66 by the return spring 70 before air is supplied again to the suction nozzle 64, the air current flows without hindrance. After the completion of the operation of the controllers 82 and 83 has been confirmed, the next signal K is applied to the flip-flops 80 and 81 to reset the same.

The embodiment described herein is provided with a yarn detector 61 in addition to the feelers, however, the yarn detector 61 and the feelers may be substituted by a single detector capable of the functions of the yarn detector 61 and the feelers, and the output signal of the feeler 73 may be used instead of the output signal of the yarn detector 61.

Although the invention has been described in its preferred form with a certain degree of particularity, it is to be understood that many variations and changes may be made in the invention without departing from the scope thereof.

What is claimed is:

1. A mispick removing apparatus for a shuttleless loom having a picking nozzle which picks weft yarns along a picking path into a shed formed by warp threads of a fabric, comprising:

selectively actuable picking-side mispick removing means disposed on the same side of the fabric as said picking nozzle;

selectively actuable receiving-side mispick removing means disposed on a side of the fabric opposite from said picking nozzle; and mispick detecting means responsive to the presence of a mispicked yarn in the shed for actuating at least one of said picking-side and receiving-side removing means; wherein said mispick detecting means actuates both said picking-side mispick removing means and said receiving-side mispick removing means in response to a mispicked yarn which is broken; and wherein said mispick detecting means actuates only said picking-side mispick removing means in response to a mispicked yarn which is unbroken.

2. A mispick removing apparatus according to claim 1, wherein said receiving-side mispick removing means includes suction nozzle means for sucking part of a mispicked yarn into said receiving-side mispick removing means, and means having a pair of rollers for thereafter pulling the part of the mispicked yarn into said receiving-side mispick removing means.

3. A mispick removing apparatus according to claim 1, wherein said picking-side mispick removing means includes:

a guide nozzle disposed between said picking nozzle and the fabric for moving a mispicked yarn away from the picking path and guiding it to a predetermined position;

winding means at said predetermined position for gripping and winding up the mispicked yarn to thereby extract the mispicked yarn from a fell of the fabric;

cutter means disposed between said picking nozzle and said winding means for cutting the mispicked yarn;

and yarn detector means for detecting the presence of a mispicked yarn in a guide passage which is provided in said picking-side mispick removing means and through which the mispicked yarn is extracted.

4. A mispick removing apparatus according to claim 3, wherein said receiving-side mispick removing means includes a main body having an inlet opening on a side thereof facing said fabric and having an exhaust duct which is in fluid communication with said inlet opening, first and second rotatably supported rollers disposed within said main body, means for effecting relative movement of said rollers between engaging and spaced positions in which they are respectively engaging and spaced from each other, drive means for effecting rotation of said first roller, and suction nozzle means in the region of said inlet opening for drawing an end portion of a mispicked weft yarn into said main body to a location between said rollers; wherein when the end portion of the mispicked yarn is disposed between said rollers, said rollers are moved to said engaging position so as to grip the mispicked yarn therebetween, rotation of the rollers causing the mispicked yarn to be moved out of the shed into said main body and then into said exhaust duct.

5. A mispick removing apparatus according to claim 4, wherein said means for effecting relative movement of said first and second rollers includes resilient means yieldably urging said second roller in a direction away from said first roller and includes selectively actuable fluid cylinder means cooperable with said second roller for effecting movement of said second roller toward said first roller against the urging of said resilient means.

6. A mispick removing apparatus according to claim 5, wherein said receiving-side mispick removing means includes in the region of said inlet opening in said main body a yarn guide member which guides a mispicked yarn into said inlet opening and yarn detector means for detecting the presence of a mispicked yarn in the region of said inlet opening.

7. A mispick removing apparatus according to claim 5, including a waste box which communicates with said exhaust duct at an end thereof remote from said rollers.

* * * * *